US006534927B1

(12) United States Patent
Takaoka

(10) Patent No.: US 6,534,927 B1
(45) Date of Patent: Mar. 18, 2003

(54) MULTIPLE-LIGHT COLD-CATHODE TUBE LIGHTING DEVICE

(75) Inventor: Hironori Takaoka, Kumamoto (JP)

(73) Assignee: Kabushiki Kaisha Advanced Display, Kumamoto (JP)

( * ) Notice: Subject to any disclaimer, the term of this patent is extended or adjusted under 35 U.S.C. 154(b) by 0 days.

(21) Appl. No.: 09/984,352

(22) Filed: Oct. 29, 2001

(51) Int. Cl.[7] ..... H05B 41/36

(52) U.S. Cl. ..... 315/224; 315/276; 315/209 R

(58) Field of Search ..... 315/224, 262, 315/278, 291, 313, 320, 276, 277, 282, 209 R, 212, 219, 220; H05B 41/36, 41/24

(56) References Cited

U.S. PATENT DOCUMENTS

| | | | | | |
|---|---|---|---|---|---|
| 5,495,405 | A | * | 2/1996 | Fujimura et al. | 363/133 |
| 5,959,412 | A | * | 9/1999 | Ushijima | 315/276 |
| 6,054,813 | A | * | 4/2000 | Takeda et al. | 315/209 R |
| 6,072,702 | A | * | 6/2000 | Nakao et al. | 363/19 |
| 2002/0047619 | A1 | * | 4/2002 | Oura et al. | 315/276 |
| 2002/0050973 | A1 | * | 5/2002 | Takaoka et al. | 345/100 |

FOREIGN PATENT DOCUMENTS

| | | | | |
|---|---|---|---|---|
| JP | 59-132595 | | 7/1984 | H05B/41/24 |
| JP | 60-25198 | | 2/1985 | H05B/41/42 |
| JP | 4-298995 | | 10/1992 | H05B/41/24 |
| JP | 6-111989 | | 4/1994 | H05B/41/392 |
| JP | 8-288084 | | 11/1996 | H05B/41/24 |
| JP | P2002-319793 | * | 11/2001 | H05B/41/24 |

* cited by examiner

*Primary Examiner*—Don Wong
*Assistant Examiner*—Trinh Do Dinh
(74) *Attorney, Agent, or Firm*—McDermott, Will & Emery

(57) ABSTRACT

A multiple-light cold-cathode tube lighting device of the invention includes a main inverter circuit 1 constituted by a positive feedback amplifying circuit including transistors Q1, Q2 and having an oscillating function, and a sub-inverter circuit 2 constituted similarly to the main inverter circuit 1. One of the base windings is connected to the positive feedback circuits of the two inverter circuits. Cold-cathode tubes CCFL1 connected to respective output ends of the two transformers T1, T2 of the main inverter circuit 1 are synchronized with cold-cathode tubes CCFL2 connected to respective output ends of two transformers of the sub-inverter circuit 2, and the cold-cathode tubes CCFL1, CCFL2 can be individually subjected to light control by using switches.

2 Claims, 2 Drawing Sheets

| LIGHT CONTROL PATTERN | CCFL1 | CCFL2 | S1 | S2 | S3 | S4 |
|---|---|---|---|---|---|---|
| 1 | ON | ON | ON | OFF | ON | ON |
| 2 | ON | OFF | ON | OFF | ON | OFF |
| 3 | OFF | ON | OFF | ON | OFF | ON |
| 4 | OFF | OFF | OFF | OFF | OFF | OFF |

Prior Art

MULTIPLE-LIGHT COLD-CATHODE TUBE LIGHTING DEVICE

BACKGROUND OF THE INVENTION

1. Field of the Invention

The present invention relates to a multiple-light cold-cathode tube lighting device used for a display device.

2. Description of the Related Art

In general, a liquid crystal display panel having a built-in backlight is used for a display portion of a computer or the like, and a plurality of cold-cathode tubes are used as the backlight of this liquid crystal display panel in order to ensure brightness and to prevent unevenness of luminous intensity.

In the multiple-light cold-cathode tubes, since a flicker is generated by lighting frequency fluctuation, it is necessary that an oscillating circuit is made common to the cold-cathode tubes to establish mutual synchronization of them and to suppress the flicker.

FIGS. 3 and 4 show conventional multiple-light lighting devices.

FIG. 3 is a circuit diagram showing a conventional multiple-light lighting device, which is disclosed in Japanese Patent Laid-Open No. 298995/1992.

In FIG. 3, reference numerals 1 and 2 designate inverter circuits, respectively. Reference characters Q1, Q2, Q3 and Q4 designate transistors; C1, C2, C3 and C4, capacitors; T1 and T2, transformers; and Nf1, a base winding of the transformer T1. Reference character L1 designates a choke coil; and CCFL1 and CCFL2, cold-cathode tubes.

The multiple-light lighting device of FIG. 3 is constituted by the pair of the inverter circuits 1 and 2, the base winding Nf1 of the transformer T1 of the inverter circuit 1 is inputted to the respective oscillating circuits, so that lighting frequencies of the respective cold-cathode tubes CCFL1 and CCFL2 are made identical to each other.

FIG. 4 is a circuit diagram showing a conventional multiple-light lighting device.

In FIG. 4, reference numeral 1 designates an inverter circuit; Q1 and Q2, transistors; C1, C2 and C3, capacitors; and T1 and T2, transformers. Reference character L1 designates a choke coil; and CCFL1 and CCFL2, cold-cathode tubes.

The multiple-light lighting device of FIG. 4 is constituted by the inverter circuit including the choke coil L1, and the two output transformers T1 and T2. By connecting the transformer T1 and the transformer T2 of the inverter circuit in parallel, the same lighting frequency is held in common, and output synchronization is established.

Although all of the plurality of cold-cathode tubes can be synchronized by the foregoing technique, there has been a problem that it can not satisfy a light control system further diversified in future.

SUMMARY OF THE INVENTION

The present invention has been made to solve the foregoing problem, and an object of the invention is to provide a multiple-light cold-cathode tube lighting device in which a plurality of cold-cathode tubes are mutually synchronized to prevent a flicker, while they can be independently subjected to light control.

A multiple-light cold-cathode tube lighting device of the present invention includes a first inverter constituted by a first amplifying circuit having an oscillating function and first transformers connected to the first amplifying circuit and including a first base winding, first cold-cathode tubes connected to output ends of the first transformers, a second inverter constituted by a second amplifying circuit having an oscillating function and second transformers connected to the second amplifying circuit and including a second base winding, and second cold-cathode tubes connected to output ends of the second transformers, and one of the first base winding of the first inverter and the second base winding of the second inverter is selected and is connected to the first amplifying circuit and the second amplifying circuit.

Besides, the first amplifying circuit and the second amplifying circuit are respectively connected to power sources through switches, and lighting of the first cold-cathode tubes and lighting of the second cold-cathode tubes are individually controlled by controlling the switches.

DETAILED DESCRIPTION OF THE PREFERRED EMBODIMENTS

Embodiment 1

Embodiment 1 will be described in detail with reference to the drawings.

Figures 1, 2:
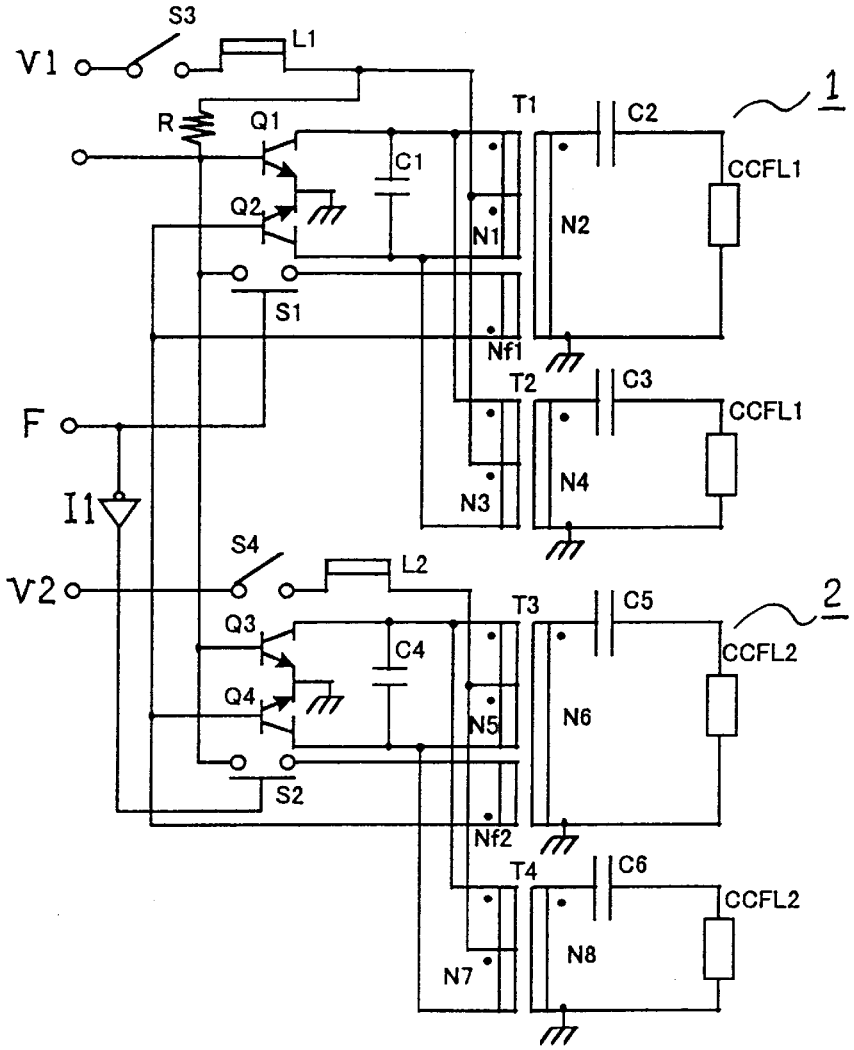
FIG. 1 is a circuit diagram showing a multiple-light cold-cathode tube lighting device according to embodiment 1 of the present invention.
FIG. 2 is a view showing light control lighting on/off patterns of cold-cathode tubes of the multiple-light cold-cathode tube lighting device according to the embodiment 1 of the present invention and switch operations in connection with those.
Figure 3:
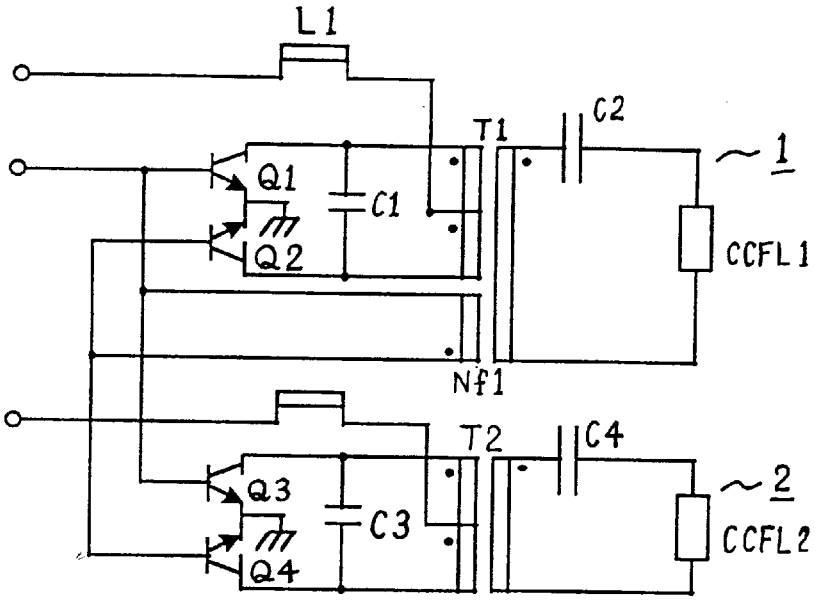
FIG. 3 is a circuit diagram showing a conventional multiple-light lighting device.
Figure 4:
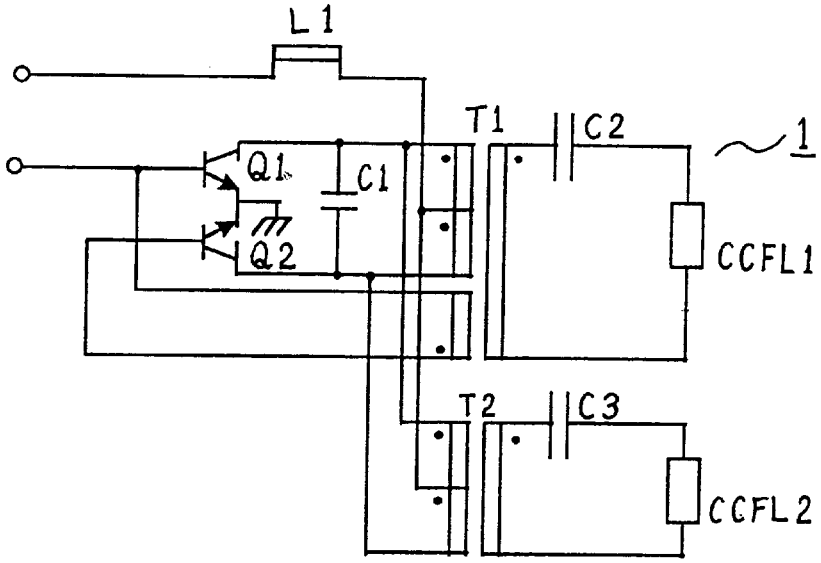
Prior Art Fig. 4
FIG. 4 is a circuit diagram showing a conventional multiple-light lighting device.

FIG. 1 is a circuit diagram showing a multiple-light cold-cathode tube lighting device according to the embodiment 1 of the present invention.

In FIG. 1, reference numeral 1 designates a main inverter circuit (first inverter circuit) constituted by using a positive feedback amplifying circuit having a self-oscillating function; and 2, a sub-inverter circuit (second inverter circuit) constituted similarly to the main inverter circuit 1.

First, the structure of the main inverter circuit 1 will be described.

The main inverter circuit 1 is constituted by using a positive feedback amplifying circuit (first amplifying circuit) having a self-oscillating function. The positive feedback amplifying circuit is constituted by transistors Q1 and Q2, respective emitters of the transistors Q1 and Q2 are grounded, and respective collectors thereof are connected to both ends of each of primary windings N1 and N3 of output transformers T1 and T2 (first transformers) in parallel.

Besides, a switch S3 and a choke coil L1 are connected to a power source line V1, and center taps of the primary windings N1 and N3 are connected to an output side of the choke coil L1. On the other hand, respective bases of the transistors Q1 and Q2 are connected to the output side of the choke coil L1 through a resistor R, and are connected to both ends of a base winding Nf1 (first base winding) provided in the output transformer T1. Besides, a capacitor C1 is connected between the collectors of the transistors Q1 and Q2.

One end of each of secondary windings N2 and N4 of the output transformers T1 and T2 is connected to an earth output terminal. The other ends are respectively connected through capacitors C2 and C3 to respective output terminals. Each of cold-cathode tubes CCFL1 (first cold-cathode tubes) is connected between the output terminal and the earth output terminal.

The sub-inverter circuit 2 also has a similar circuit structure to the main inverter circuit 1.

The sub-inverter circuit 2 is constituted by using a positive feedback amplifying circuit (second amplifying circuit) having a self-oscillating function, and the positive feedback amplifying circuit is constituted by transistors Q3 and Q4. Respective emitters of the transistors Q3 and Q4 are grounded, and respective collectors thereof are connected to both ends of each of primary windings N5 and N7 of output transformers T3 and T4 (second transformers) in parallel.

Besides, a switch S4 and a choke coil L2 are connected to a power source line V2, and center taps of the primary windings N5 and N7 are connected to an output side of the choke coil L2. On the other hand, respective bases of the transistors Q3 and Q4 are connected to the output side of the choke coil L1 through the resistor R, and are connected through a switch S2 to both ends of a base winding Nf2 (second base winding) provided in the output transformer T3. Besides, a capacitor C4 is connected between the collectors of the transistors Q3 and Q4.

One end of each of secondary windings N6 and N8 in the output transformers T3 and T4 is connected to a grounded earth output terminal. The other ends are respectively connected to output terminals through capacitors C5 and C6. Then, each of cold-cathode tubes CCFL2 (second cold-cathode tubes) is connected between the output terminal and the earth output terminal.

The base of the transistor Q1 and the base of the transistor Q3 are connected to one end of the base winding Nf2 through the switch S2. The transistors Q2 and Q4 are connected to the other end of the base winding Nf2. An on/off line F is connected to the switch S2 through the switch S1 and an inverter element I1.

FIG. 2 is a view showing light control lighting on/off patterns of the cold-cathode tubes of the multiple-light cold-cathode tube lighting device according to the embodiment 1 of the present invention and switch operations in connection with those.

In the embodiment 1, two kinds of conventional lighting systems are combined and constitute the multiple-light cold-cathode tube lighting device for lighting a plurality of cold-cathode tubes. That is, the feature is that two inverter circuits each constituted by the positive feedback amplifying circuit having the oscillating function and the two output transformers are prepared, the base windings Nf1 and Nf2 respectively provided with the switches S1 and S2 are connected to the mutual positive feedback amplifying circuits, and the switches S3 and S4 are provided in the power source input portions of the respective inverter circuits for light control.

In the multiple-light cold-cathode tube lighting device constituted in this way, the one main inverter circuit 1 having the oscillating function is provided, and the other sub-inverter circuit 2 functions merely as an amplifier for amplifying a signal oscillated from the main inverter circuit 1. However, according to a lighting state, the main and the sub are exchanged by the switches S3 and S4. Thus, the operation frequency of the sub-inverter circuit 2 becomes completely identical to that of the main inverter circuit 1 and is synchronized. Then, an arbitrary cold-cathode tube can be subjected to light control by the respective switches S1 and S2 provided at the power source lines V1 and V2 and the base windings Nf1 and Nf2.

Specifically, light control is performed by inputting PWM signals to the respective switches S1, S2, S3 and S4. Here, as a light control lighting form, four patterns of on/off of the cold-cathode tubes CCFL1 and CCFL2 as shown in FIG. 2 can be given. FIG. 2 shows these and the switch operations at the respective patterns. In this switch operation, when the cold-cathode tube CCFL1 is turned on, synchronization is established by using the base winding Nf1 of the main inverter circuit 1. However, in the case where only the cold-cathode tube CCFL 2 is turned on, since the base winding Nf1 of the main inverter circuit 1 does not operate, an output is made by the base winding Nf2 of the sub-inverter circuit 2. That is, the base winding Nf2 of the sub-inverter circuit 2 is operated by the switch S2 only when the cold-cathode tube CCFL1 is turned off and the cold-cathode tube CCFL2 is turned on.

According to the embodiment 1, in the two inverter circuits each constituted by using the positive feedback amplifying circuit having the oscillating function, since the common oscillation circuit is provided, the output synchronization of lighting frequencies is completely established at all the cold-cathode tubes. Further, an arbitrary cold-cathode tube can be subjected to light control by respectively adding and operating the switches to the respective power source lines and base windings. That is, synchronization of the respective cold-cathode tubes is established, and generation of a flicker is prevented, while an arbitrary cold-cathode tube can be independently subjected to light control.

Since the present invention is constructed as described above, the effects as set forth below can be obtained.

The multiple-light cold-cathode tube lighting device includes the first inverter constituted by the first amplifying circuit having the oscillating function and the first transformers connected to the first amplifying circuit and including the first base winding, the first cold-cathode tubes connected to the output ends of the first transformers, the second inverter constituted by the second amplifying circuit having the oscillating function and the second transformers connected to the second amplifying circuit and including the second base winding, and the second cold-cathode tubes connected to the output ends of the second transformers, and one of the first base winding of the first inverter and the second base winding of the second inverter is selected and is connected to the first amplifying circuit and the second amplifying circuit, whereby synchronization of the cold-cathode tubes is established and the operation can be made, and a light control method of the cold-cathode tubes can be diversified.

Besides, the first amplifying circuit and the second amplifying circuit are respectively connected to the power sources through the switches, and lighting of the first cold-cathode tubes and lighting of the second cold-cathode tubes are individually controlled by controlling the switches, whereby the first cold-cathode tubes and the second cold-cathode tubes can be separately subjected to light control.

What is claimed is:

1. A multiple-light cold-cathode tube lighting device, comprising:

a first inverter constituted by a first amplifying circuit having an oscillating function and first transformers connected to the first amplifying circuit and including a first base winding;

first cold-cathode tubes connected to output ends of the first transformers;

a second inverter constituted by a second amplifying circuit having an oscillating function and second transformers connected to the second amplifying circuit and including a second base winding; and second cold-cathode tubes connected to output ends of the second transformers, wherein one of the first base winding of the first inverter and the second base winding of the second inverter is selected and is connected to the first amplifying circuit and the second amplifying circuit.

2. A multiple-light cold-cathode tube lighting device according to claim 1, wherein the first amplifying circuit and the second amplifying circuit are respectively connected to power sources through switches, and lighting of the first cold-cathode tubes and lighting of the second cold-cathode tubes are individually controlled by controlling the switches.

* * * * *